United States Patent [19]

Rollo

[11] Patent Number: 4,604,919

[45] Date of Patent: Aug. 12, 1986

[54] OPEN END RATCHET SOCKET WRENCH

[76] Inventor: Richard P. Rollo, 712 S. Spruce, Pana, Ill. 62557

[21] Appl. No.: 679,130

[22] Filed: Dec. 6, 1984

[51] Int. Cl.[4] ..... B25B 13/00

[52] U.S. Cl. ..... 81/58.2; 81/61

[58] Field of Search ..... 81/58.2, 124.2, 61

[56] References Cited

U.S. PATENT DOCUMENTS

| | | | |
|---|---|---|---|
| 1,373,180 | 3/1921 | Durgan et al. | 81/58.2 |
| 1,422,121 | 7/1922 | Millen | 81/58.2 |
| 2,401,128 | 5/1946 | Anderson | 81/58.2 |
| 2,578,687 | 12/1951 | Fish | 81/58.2 |
| 2,691,315 | 10/1954 | Brame | 81/58.2 |
| 2,693,123 | 11/1954 | Fish | 81/58.2 |
| 3,077,801 | 2/1963 | Rostad | 81/61 |
| 3,620,105 | 11/1971 | Batten | 81/58.2 |

*Primary Examiner*—James L. Jones, Jr.

*Attorney, Agent, or Firm*—Fuller, House & Hohenfeldt

[57] ABSTRACT

An open end ratchet socket wrench has sockets with a slot in the side wall. Teeth on the circumference of the socket engage and cooperate with pawls on the wrench head.

2 Claims, 6 Drawing Figures

OPEN END RATCHET SOCKET WRENCH

FIELD OF THE INVENTION

The invention relates to open-end socket wrenches for manipulating nuts which are in line on conduits or pipe.

BACKGROUND OF THE INVENTION

Various types of socket wrenches have been contemplated to access fittings and nuts associated with conduits which are commonly used for plumbing, electrical, hydraulic fittings and lines etc. The Fish U.S. Pat. Nos. 2,578,687 and 2,693,123 are examples of wrenches of this type. The Brame U.S. Pat. No. 2,691,315 also discloses an open sided or open end socket wrench. The Mille U.S. Pat. No. 1,422,121 shows an open end ratchet wrench but does not disclose use thereof with sockets of varying sizes. The wrenches disclosed in the Fish and Brame patents all employ an integral rotatable ratchet ring which cooperates with a ratchet or escapement mechanism and in which the socket interfits with the configured surfaces on the ring. This adds to the expense of the wrench and requires that the ring slot be aligned with the head slot to enable removal of the wrench from the conduit. Hence, the socket must be rotated to align the socket slot, ring slot and wrench head slot to remove the wrench from the work.

SUMMARY OF THE INVENTION

The invention provides an open-ended socket wrench which does not employ an inner ratcheting ring but in which the sockets with a slot in the side wall are provided with circumferentially arranged teeth to cooperate directly with spring loaded detents or pawls supported on the wrench head to provide the escapement mechanism. Manual release or overriding of the spring biasing of the springs for the pawls enables the sockets to be easily and readily withdrawn from the wrench head even though the wrench head slot is not in register with the socket slot. The wrench is easily removed from the work without the inconvenience of adjusting a ratchet ring into alignment with the wrench head slot. As far as is known, none of the prior art wrenches identified above have become commercially available because of the drawbacks hereinabove noted.

Further objects, advantages and features of the invention will become apparent from the disclosure.

DESCRIPTION OF THE PREFERRED EMBODIMENT

Although the disclosure hereof is detailed and exact to enable those skilled in the art to practice the invention, the physical embodiments herein disclosed merely exemplify the invention which may be embodied in other specific structure. The scope of the invention is defined in the claims appended hereto.

Figure 1:
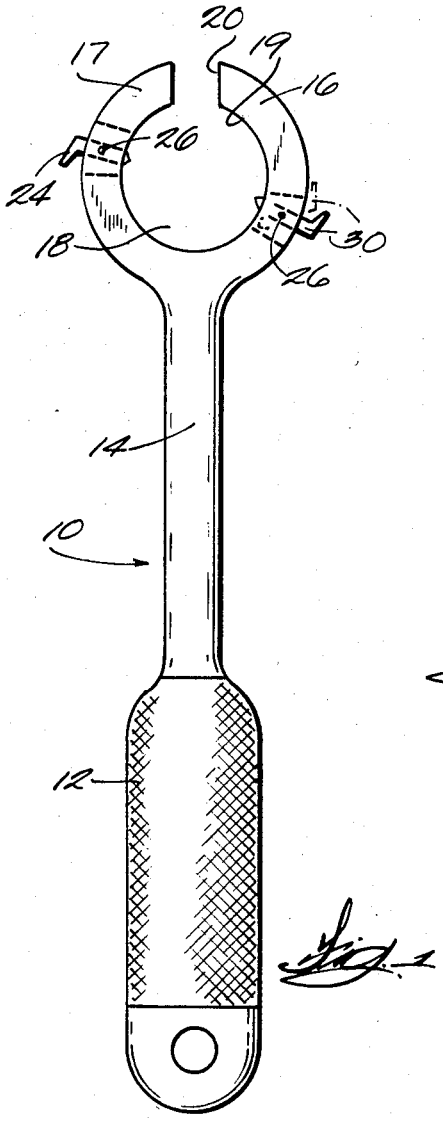
FIG. 1 is a plan view of a wrench in accordance with the invention.
Figure 2:
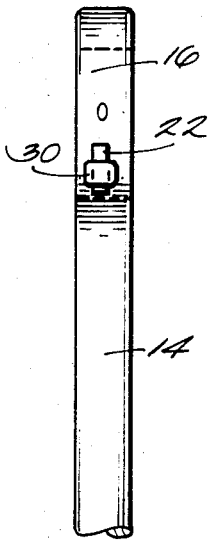
FIG. 2 is a side view.
Figure 5:
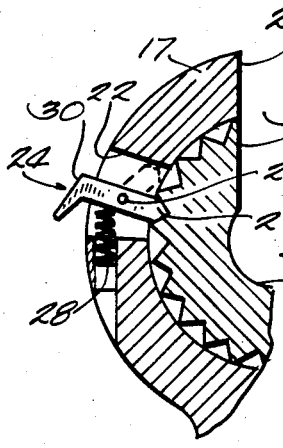
FIG. 5 is an enlarged fragmentary sectional view of the wrench head shown in FIG. 1.

FIG. 1 discloses a wrench 10 which has a handle 12 and a neck portion 14. A wrench head 16 is integrally joined with the neck portion 14. The wrench head has wall means 17 defining a cylindrical opening 18 with a distal slot 20 intended to be insertable over a line or conduit to enable access to an inline nut. The head portion also has wall means defining cavities or recesses 22 which are sized to receive pawls 24 which are pivotally supported by pins 26 secured to the wrench head 16. The pawls constitute the drive means. As illustrated in FIG. 5, the pawls 24 are spring biased by springs 28 to position pawl tips 27 in an engagement position with a socket as hereinafter described. The pawls have a projecting head 30 beyond the outline of the wrench head to facilitate manual manipulation thereof for insertion and release of the sockets.

Figure 3:
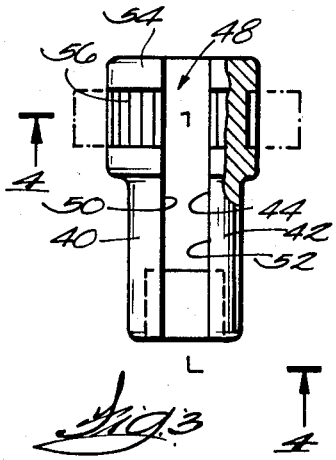
FIG. 3 is a partially broken away view of a socket which cooperates with the wrench of the invention.
Figure 4:
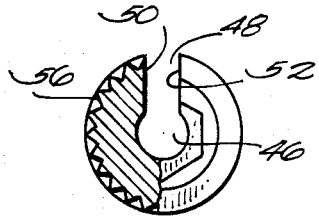
FIG. 4 is a view of the socket taken along line 4—4 of FIG. 3.

The sockets which cooperate with the wrench illustration in FIG. 1 are disclosed in FIG. 3. The socket 40 is provided with a cylindrical wall portion 42 with internal flats 44 arranged in appropriate geometric relationship to engage a hex nut or the like. The flats 44 are arranged around a central aperture 46 which communicates with an elongated slot 48 defined by socket walls 50 and 52. The socket 40 has a head portion 54 which can be enlarged with respect to the part 40 and provided with circumferentially arranged teeth 56 which are arranged at a radius adapted to interfit into the opening 18 in the wrench head 16 and cooperate with and be engaged with the pawls 24 as illustrated in FIG. 5. The surface 19 provides for rotatable support of the socket 40.

Figure 6:
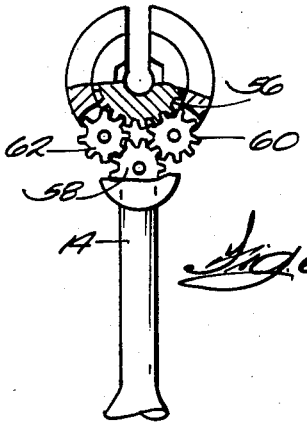
FIG. 6 is a modified embodiment of the invention in which the socket is driven by a motor through a gear train.

FIG. 6 shows a modified embodiment in which gears 60 and 62 are employed to engage the teeth 56 of the socket. A driving member 58 is employed which can be coupled to an air motor or other motor or device for rotating the socket.

In use the socket is inserted in the wrench head by manually pivoting the pawls from the cylindrical plane defined by the surface 19. The pawls are then released and the wrench can be ratcheted in either direction. The wrench is placed in operative position on an inline nut by aligning the slot 48 in the socket head with the slot 20 in the wrench head and slipping the wrench over the line and moving the wrench axially into position over the line onto the nut. When the tightening of the nut or loosening thereof is accomplished, the socket can be easily released by manually releasing the pawls and the socket pulled axially from the wrench head no matter what position the socket is in. The wrench can then be withdrawn from the conduit.

I claim:

1. The combination of an open end socket wrench for turning nuts and a cooperating socket comprising a wrench handle portion, a wrench head portion, said head portion having wall means defining a socket receptacle in the form of an annular ring with concentric inside and outside surfaces and parallel upper and lower surfaces, wall means in said annular ring defining opposed recesses extending from said inside ring surface to said outside surface and between said upper and lower surfaces, said head portion adapted to rotatably support said socket, with said inner surface rotatably engaging said socket, wall means defining a slot in said socket wrench head and drive means on said socket head engagable with said socket to drive said socket in a selected direction and release said socket in the other direction as said handle is returned to a driving position, said drive means including pawls, pivot pins for each of said pawls, said pins extending between said upper and lower surfaces, said pins being located on a concentric circle with respect to said inside ring surface to pivotally support said pawls in said recesses for pivotal movement in a plane transverse to said socket rotation with said pawls extending outwardly of said rings for manual engagement and release with said pawl tips movable into and from said socket receptacle and springs in said recesses in said wrench heads engaged with said pawls at a point remote from said pivot pins, and biasing said pawls about said pivot pins, said socket adapted to rotatable interfit in said wrench head and wall means on said socket which cooperate with said wrench drive means to afford driving of said socket and wall means on said socket defining a slot which registers with said wrench head slot to enable access to inline nuts.

2. The combination of claim 1 wherein said wall means on said socket comprise circumferentially arranged teeth.

* * * * *